US005490044A

United States Patent [19]

Kobayashi et al.

[11] Patent Number: 5,490,044

[45] Date of Patent: Feb. 6, 1996

[54] ELECTRIC TERMINAL ASSEMBLY

[75] Inventors: Denzaburo Kobayashi, Tokyo; Toshiaki Asami, Kamagaya, both of Japan

[73] Assignee: RKC Instrument Inc., Tokyo, Japan

[21] Appl. No.: 371,794

[22] Filed: Jan. 12, 1995

[30] Foreign Application Priority Data

Jan. 13, 1994 [JP] Japan ..... 6-015873

[51] Int. Cl.[6] ..... H01R 9/00

[52] U.S. Cl. ..... 361/823; 361/752; 361/759; 361/801; 361/798; 439/160

[58] Field of Search ..... 361/752, 759, 361/196, 801, 798, 754, 823; 439/157–160

[56] References Cited

U.S. PATENT DOCUMENTS

| | | | |
|---|---|---|---|
| 5,062,024 | 10/1991 | Hennemann | 361/426 |
| 5,363,281 | 11/1994 | Baitz et al. | 361/801 |
| 5,398,167 | 3/1995 | Joist et al. | 361/801 |

FOREIGN PATENT DOCUMENTS

| | | |
|---|---|---|
| 2-69735 | 5/1990 | Japan . |
| 4-45922 | 4/1992 | Japan . |
| 5-87826 | 11/1993 | Japan . |
| 6-15873 | 1/1994 | Japan . |

*Primary Examiner*—Leo P. Picard
*Assistant Examiner*—Y. Whang
*Attorney, Agent, or Firm*—Foley & Lardner

[57] ABSTRACT

In a terminal assembly for electronic and electric equipment, the terminal member is formed into the shape of letter-C by being provided with a middle piece, and first and second arms extending from two opposite ends of the middle piece at an acute angle and at an obtuse angle, respectively. The first and second arms are fitted into a retaining window of a casing to secure the terminal member onto the casing. The first arm is reduced in thickness from its middle part toward its free end or is otherwise increased of its flexibility so as to form a spring portion. A terminal screw is threaded into the middle piece toward the first arm at an oblique angle. A connecting electrode of a circuit board received in the casing resiliently engages the spring portion of the terminal member. Thus, the structure of the terminal assembly is simplified, a favorable resilient contact is ensured between the terminal member and the circuit board, the terminal assembly is made easier to use, the terminal screw can be securely threaded into the middle piece, and the size of the terminal assembly is minimized.

6 Claims, 5 Drawing Sheets

ELECTRIC TERMINAL ASSEMBLY

TECHNICAL FIELD

The present invention relates to an electric terminal assembly for electric and electronic equipment such as measuring instruments, and in particular to an improvement of an electric terminal assembly adapted to be mounted on a casing, and having an outer end adapted to be connected to an external lead and an internal end adapted to engage a connecting electrode of a circuit board.

BACKGROUND OF THE INVENTION

Conventionally, various terminal assemblies have been proposed for measuring instruments, and, for instance, the applicant of this application has previously proposed a novel structure in Japanese utility model application No. 2-87524.

According to this structure, as shown in FIG. 7, a nut member 3 formed by bending a relatively thick electroconductive plate into the shape of letter-C is secured inside a terminal spring member 1 likewise formed by bending a thin electroconductive plate into the shape of letter-C. The terminal spring member 1 thus incorporated with the nut member 3 is retained by a casing 7 by engaging spring pieces 5*a* and 5*b* cut out and lifted from the two arms 1*a* and 1*b* of the terminal spring member 1 with engagement portions 7*a* and 7*b* of the casing 7. A terminal screw 9 is threaded into a threaded hole 11 of the nut member 3. A contact piece 13 is formed at a free end of one of the arms 1*b* of the terminal spring member 1.

When a circuit board 17 is pushed into this terminal assembly guided by an insertion groove 15 provided in the casing 7, a connecting electrode (not shown in the drawing) is resiliently engaged by the contact piece 13. Thus, once an external lead (not shown in the drawing) is connected to the terminal spring member 1, it will be also connected to the circuit board 17.

Furthermore, the entire assembling work is extremely simplified because the nut member 3 can be easily secured in the terminal spring member 1 to join them together, and the threading of the terminal screw 9 is also simple.

However, according to such a terminal assembly for measuring instruments, although some improvement has been made in terms of the simplification of the assembling work, there still is a need for a nut member 3 which is thicker than the terminal spring member 1 to reliably retain the terminal screw 9, and more improvements are desired in the way of reducing the number of component parts and even further simplifying the assembling work.

It is conceivable to integrally form the terminal spring member 1 and the nut member 3 with a thick electroconductive member. However, although it will ensure the terminal screw 9 to be retained in a reliable fashion, the terminal spring member 1 will lose a favorably resiliency that would ensure a reliable and ready electric contact between the connecting electrode of the circuit board 17 received in the casing 7 and the terminal spring member 1 or the nut member 3.

As an additional problem, to avoid interference between the terminal screw and the printed circuit board, it is necessary either to limit the length of the terminal screw or to increase the size of the terminal assembly itself. A short terminal screw is highly inconvenient because the terminal screw may not be unthreaded enough to accommodate an external lead to be connected thereto without entirely unthreading the terminal screw out of the threaded hole. Also, the size of the terminal assembly is desired to be minimized because a large number of such terminal assemblies are normally required to be provided in a limited space.

BRIEF SUMMARY OF THE INVENTION

In view of such problems of the prior art, a primary object of the present invention is to provide an electric terminal assembly for electric and electronic equipment which is simple in structure and economical to fabricate.

A second object of the present invention is to provide an electric terminal assembly for electric and electronic equipment which is easy and convenient to A third object of the present invention is to provide an electric terminal assembly for electric and electronic equipment which is compact in size and can be arranged in a large number in a limited space.

A fourth object of the present invention is to provide an electric terminal assembly for electric and electronic equipment which is reliable in use by ensuring a favorable contact with a connecting electrode of a circuit board at an internal end thereof.

These and other objects of the present invention can be accomplished by providing an electric terminal assembly adapted to be fitted in an window of a casing of electric or electronic equipment, comprising: a terminal member made of electroconductive material and including a middle piece having an outwardly facing surface, a first arm extending inwardly from a first end of the middle piece, and a second arm extending inwardly from a second end of the middle piece, the first arm being provided with a spring portion adapted to resiliently engage a connecting electrode provided on an edge of a circuit board fitted in the casing, at least one of the arms being provided with means for engagement with the casing for retaining the terminal member in the window; and a terminal screw threaded into a threaded opening provided in the outwardly facing surface of the middle piece; the spring portion consisting of an integral extension of the first arm having a reduced thickness and curved into the shape of letter-J. Instead of or in addition to this structure of the spring portion, the spring portion may also consist of an integral extension of the first arm which is bent at least twice back and forth, for instance, into the shape of letter-Z so as to have an increased flexibility.

Thus, a favorable resiliency can be achieved in the spring portion even though the terminal member may consist of a single piece. Furthermore, because the threaded hole for receiving the terminal screw may be provided in the middle piece of the terminal member without requiring any separate nut member or without sacrificing the resilient property of the spring portion, although the terminal member may consist of a single piece, it is possible to ensure a secure retaining of the nut member, a favorable resiliency of the spring portion, and a simple and compact structure of the terminal assembly. Also, by appropriately curving the first arm, it is possible to avoid interference with the forward end of the terminal screw.

According to a preferred embodiment of the present invention, the first arm is bent from the middle piece at an acute angle while the second arm is bent from the middle piece at an obtuse angle so that the outwardly facing surface of the middle piece defines an inclined outer surface through which the terminal screw is threaded. Thus, the terminal screw can be threaded obliquely into the middle piece so that the forward end of the terminal screw is less likely to interfere the circuit board which engages with the spring portion of the first arm, and so that a terminal piece intended to be secured to the terminal member by the terminal screw can be fitted thereon from an oblique angle without being interfered by possible projections which might be present around the terminal assembly.

In particular, if the spring portion consists of an integral extension of the first arm which is cut into at least a pair of narrow strips extending lengthwise from the first arm and defining a central slot for accommodating a forward end of the terminal screw, it is possible to even more favorably avoid interference between the forward end of the terminal screw and the spring portion because the forward end of the terminal screw may be accommodated in the central slot without touching the first arm. This is advantageous in terms of constructing the relevant structure in a highly compact manner.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
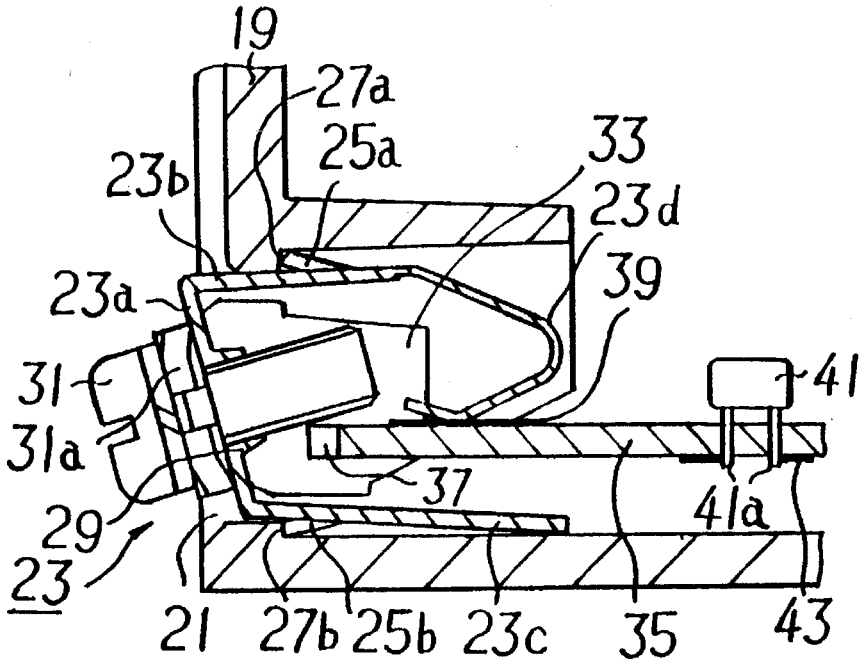
FIG. 1 is a sectional side view of a first embodiment of the electric terminal assembly according to the present invention.

FIG. 1 is a schematic sectional view of a first embodiment of the terminal assembly for measuring instruments according to the present invention.

Referring to FIG. 1, a metallic terminal member 23 serving as a main part of an electric terminal assembly is retained in a casing 19 made by molding synthetic resin material into the shape of a box by fitting the terminal member 23 into a retaining window 21 provided in a rear part of the casing 19.

Figure 2:
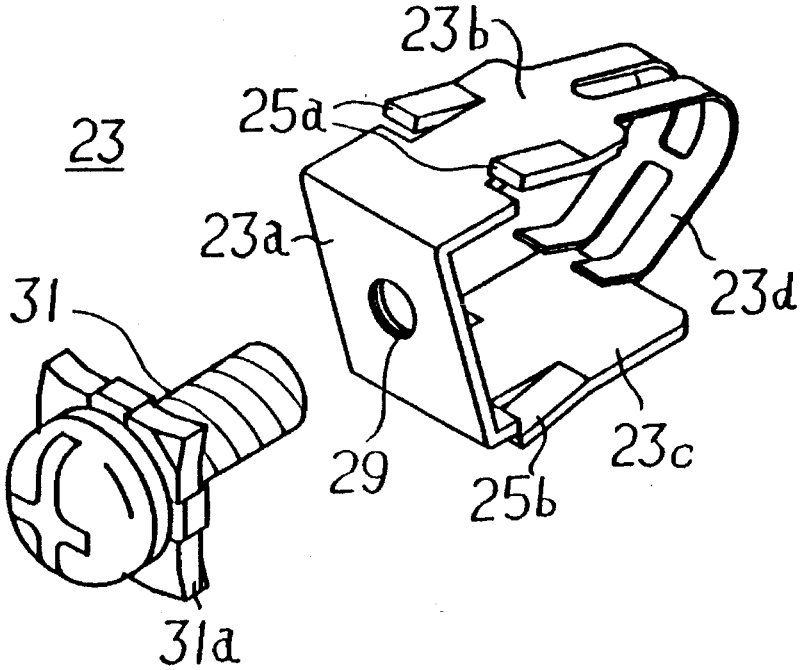
FIG. 2 is an exploded perspective view of the electric terminal assembly shown in FIG. 1.
Figure 3D:
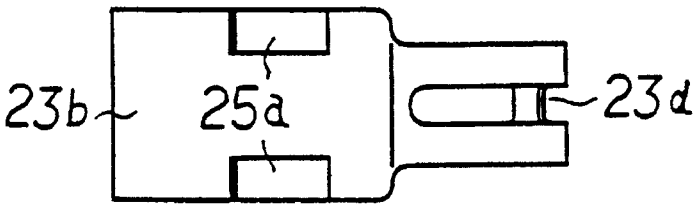
FIG. 3A through 3D are a side view, a front view, a rear view and a plan view of the terminal member shown in FIG. 1.
Figure 3C:
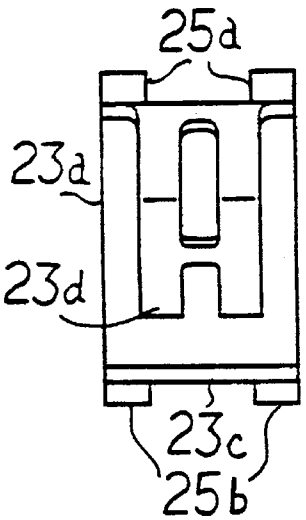
Figure 3A:
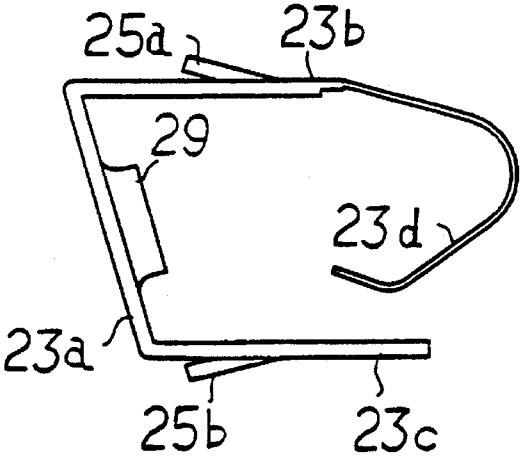
Figure 3A:
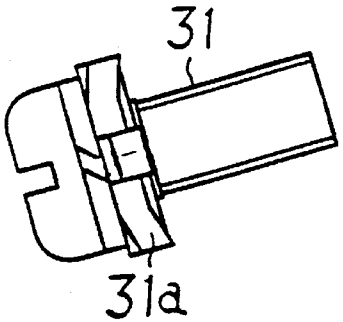
Figure 3B:
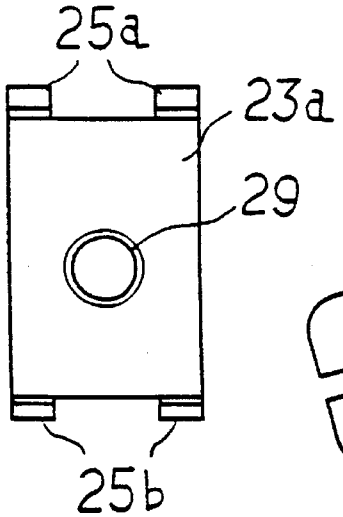

The terminal member 23 is stamped out of electroconductive sheet metal which can be easily worked and is suitably resilient by being made of such materials as phosphor-bronze, beryllium copper alloy, brass, and nickel silver, and bent into the shape of letter-C and so on as shown in FIGS. 2 and 3. The terminal member 23 comprises a middle piece 23*a*, and a pair of arms 23*b* and 23*c* extending from two opposite ends of the middle piece 23*a*, and is fitted into the retaining window 21 with the first and second arms 23*b* and 23*c* engaged to the casing 19.

More specifically, in this terminal member 23, the arm 23*b* extends from one end of the middle piece 23*a* (upper middle part of FIG. 1) at an acute angle, and the other arm 23*c* extends from the other end of the middle piece 23*a* (lower middle part of FIG. 1) at an obtuse angle so that the middle piece 23*a* extends obliquely with respect to the first and second arms 23*b* and 23*c*, and the rear surface of the casing 19, and opposes the first arm 23*b*. In this embodiment, the two arms 23*b* and 23*c* are substantially parallel to each other at their base ends, but they may either diverge or converge as required.

A pair of engagement projections 25*a* and 25*b* directed to the middle piece 23*a* are cut out from the first and second arms 23*b* and 23*c*, and are lifted outward so that the terminal member 23 may be securely lodged to the casing 19 by engaging with engagement steps 27*a* and 27*b* of the casing 19.

The arm 23*b* of the terminal member 23 is reduced in thickness from a middle part thereof toward a free end thereof so as to define a highly resilient spring portion 23*d*, and this spring portion 23*d* is curved inward into the shape of letter-J between the two arms 23*b* and 23*c*, and a free end of the spring portion 23*d* is inwardly curled as shown in the drawings. The free end portion of the spring portion 23*d* is adapted to resiliently contact a connecting electrode 39 of a circuit board 35 as described hereinafter.

As can be seen from FIG. 2, to enhance the spring property, the spring portion 23*d* consists of two laterally spaced resilient strips connected together. By thus removing part of the material from the spring portion 23*d*, the flexibility of the spring portion 23*d* can be increased. However, the present invention is not limited by this example.

There are a number of methods for reducing the thickness of the arm 23*b* from an intermediate part thereof, but machining and roll-forming are preferred.

The other arm 23*c* of the terminal member 23 may slightly curve outward as it extends, and thereby comes into contact with the inner surface of the casing 19.

A threaded hole 29 is passed through in an approximately central part of the middle piece 23*a* of the terminal member 23, and a terminal screw 31 provided with an electroconductive washer 31*a* as well as a spring washer is threaded into this threaded hole 29 from the exterior of the casing 19 toward the arm 23*b* at an oblique angle. The terminal screw 31 is dimensioned in such a manner that the free end of the terminal screw 31 would not contact the arm 23*b* even when the terminal screw 31 is fully threaded into the threaded hole 29. In other words, the J-shaped spring portion 23*d* of the arm 23*b* of the terminal member 23 surrounds the threaded portion of the terminal screw 31 at a certain distance. To ensure a firm and stable fastened condition of the terminal screw 31, a central part of the terminal member 23 surrounding the threaded hole 29 may project inwardly.

Inside the casing 19, a circuit board 35 is mounted on a retaining wall 33 extending from the outer wall of the casing 19 adjacent to the retaining window 21 by means of a retaining groove 37 or a retaining slot for retaining the circuit board 35, and the retaining wall 33 is increased in thickness in the innermost region of the retaining groove 37 and the region adjacent to the open end of the retaining window 21.

The circuit board 35 is provided with a connecting electrode 39 adapted to contact the spring portion 23*d* of the terminal member 23 at a position offset toward an edge thereof on one side thereof (upper middle part of FIG. 1). Although only one connecting electrode 39 is shown in the drawing, typically, a plurality of connecting electrodes are arranged on each circuit board, and a corresponding number of electric terminal assemblies are provided on the casing 19.

The printed circuit board 35 carries electronic component parts 41 (only one of which is shown in the drawing) on the same side as the connecting electrodes 39, and lead terminals 41*a* of these electronic component parts 41 are passed to the other side of the circuit board 35 and soldered to a printed circuit pattern 43. The electronic component parts 41 may consist of chip components without lead wires. In this case, the electronic component parts 41 may be attached to either the same side of the circuit board 35 as the connecting electrodes 39 or to the other side of the circuit board 35.

When the measuring instrument consists of a temperature controller or a temperature indicator, the circuit board 35 may carry a temperature measuring circuit for computing a measured temperature according to a temperature measurement signal from a thermo-couple or the like, a main circuit for a temperature controller or a temperature indicator, a temperature compensation circuit for compensating a temperature measurement signal and so on, but they are not shown in the drawings because they are not essential to the description of the present invention.

According to the terminal assembly of the present invention, when the circuit board 35 is pushed into the casing 19 until an edge thereof is fitted into the retaining groove 37 of the retaining wall 33, the spring portion 23d of the terminal member 23 resiliently and electrically comes into contact with the connecting electrode 39.

Therefore, when an external lead wire or an external terminal piece (not shown in the drawings) is secured to the terminal member by unfastening and fastening the terminal screw 31, electric signals from the external lead wire or the external terminal piece can be conducted to the internal circuit via the terminal member 23 and the connecting electrode 39.

Conversely, by pulling off the circuit board 35 from the retaining groove 37, it can be readily removed from the retaining wall 33 and the terminal member 23.

According to the first embodiment of the terminal assembly of the present invention, because the terminal member 23 fitted into the casing 19 comprises the middle piece 23*a* and the pair of arms 23*b* and 23*c* extending from the two opposite ends of the middle piece 23*a* substantially in the shape of letter-C, and the part of the first arm 23*b* extending from a middle part thereof to a free end thereof is formed as a spring portion 23*d* having a reduced thickness so that the spring portion 23*d* may resiliently contact the connecting electrode 39 of the circuit board 35 while the terminal screw 31 is threaded into the middle piece 23*a* of the terminal member 23, it is possible to increase the thickness of the middle piece 23*a* into which the terminal screw 31 is threaded, as well as the parts provided with the engagement projections 25*a* and 25*b* adapted to be engaged by the engagement steps 27*a* and 27*b* of the casing 19, and to reduce the thickness of the spring portion 23*d* adapted to be electrically contacted to the connecting electrode 39 of the circuit board 35.

Therefore, the nut member for threadably engaging the terminal screw 31 in the conventional structure is not required, and the resulting reduction in the number of component parts contributes to the simplification of the structure and the reduction in cost. Furthermore, a favorable resilient contact between the first arm 23*b* of the terminal member 23 and the connecting electrode 39 of the circuit board 35 is ensured, and the installing and removing of the circuit board 35 can be carried out in a reliable fashion.

Because the middle piece 23*a* of the terminal member 23 extends obliquely with respect to the first arm 23*b* and the rear surface or the outer surface of the casing 19, it is possible to arrange a plurality of similar terminal members 23 in such a manner as to allow external lead wires and external terminal pieces to be easily connected to the terminal members 23 from an oblique angle. More specifically, for instance, when placing a terminal piece under the head of the terminal screw 31 before fastening the terminal screw and thereby securing the terminal piece, the terminal 10 piece is normally required to be fitted onto the terminal screw by moving it closely along the outer surface of the casing. Therefore, according to such a conventional arrangement, some difficulty will arise in doing so when there are projections and other obstacles on the outer surface of the casing. However, according to the present invention, because the terminal piece can be fitted onto the terminal screw from an oblique angle, and, therefore, even when there are projections and other obstacles on the outer surface of the casing, it is possible to place the terminal piece to the prescribed place under the head of the terminal screw without any difficulty.

Furthermore, because the space for the retaining window 21 for retaining the terminal member 23 can be reduced, and the space efficiency can be improved thanks to this oblique arrangement of the middle piece 23*a*, a relatively large number of terminal members can be arranged even in a small measuring instrument, and the functionality of the measuring instrument can be improved.

Because the dimension of the terminal screw is so determined as not to abut the first arm 23*b* and is threaded toward the first arm 23*b* at an oblique angle, and the spring portion 23*d* of the first arm 23*b* is formed so as to surround the terminal screw 31, a space is produced between the terminal screw 31 and the second arm 23*c* which is effective for accommodating the circuit board 35 therein with the result that the space between the first and second arms 23*b* and 23*c* can be effectively utilized, and the circuit board 35 can be pressed onto the spring portion 23*d* of the first arm 23*b* without contacting the terminal screw 31.

Because the circuit board 35 carries the electronic components 41 on the same side as the connecting electrode 39, and the lead terminals 41*a* are soldered to the printed circuit pattern 43 on the other side of the circuit board 35, when soldering the lead terminals 41*a* of the electronic components 41 to the printed circuit pattern 43, it becomes possible to simply dip the side of the printed circuit pattern 43 opposite to the connecting electrode into a solder bath, and to eliminate the need to mask the connecting electrode 39 to prevent solder from being deposited on the connecting electrode 39 and to thereby improve the production efficiency.

Figure 4:
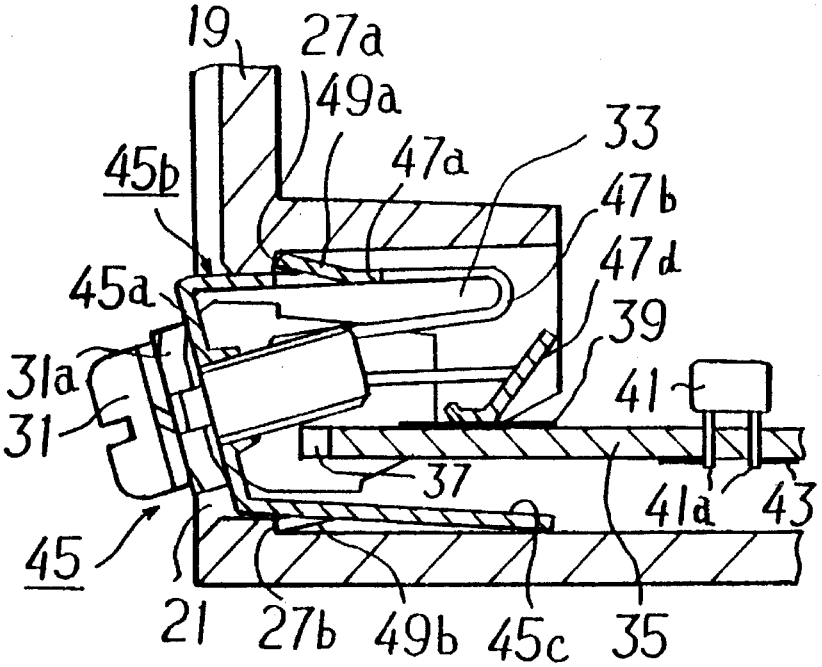
FIG. 4 is a sectional side view of a second embodiment of the electric terminal assembly according to the present invention.
Figure 5:
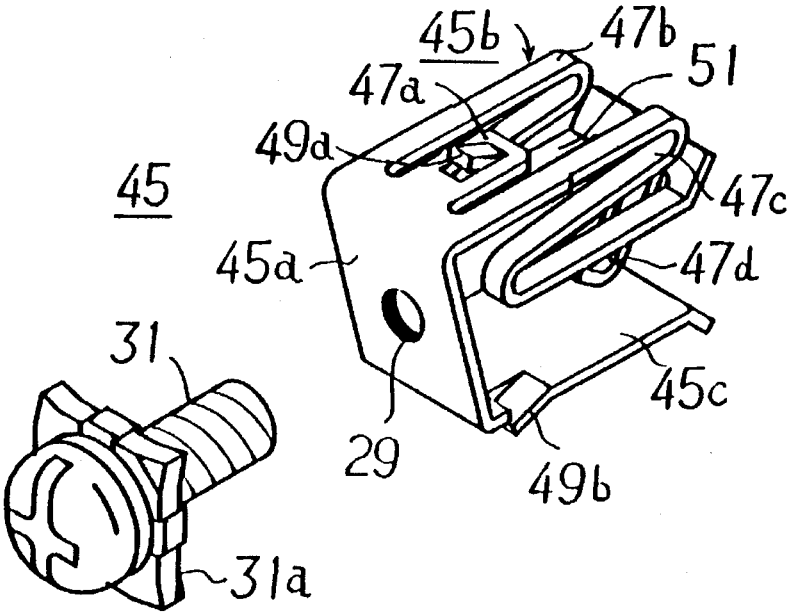
FIG. 5 is an exploded perspective view of the electric terminal assembly shown in FIG. 4.
Figure 6D:
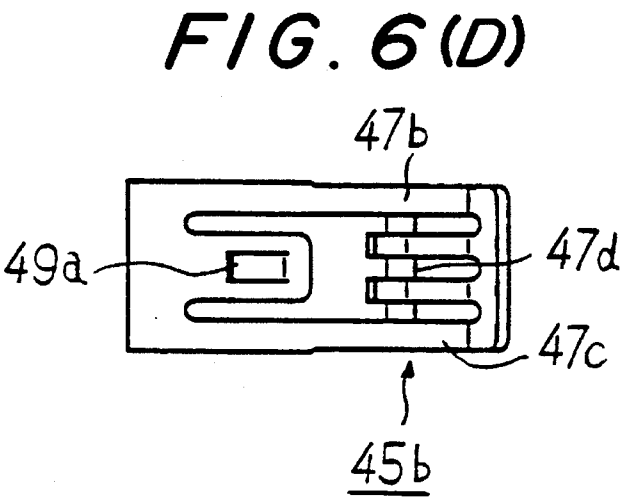
FIG. 6A through 6D are a side view, a front view, a rear view and a plan view of the terminal member shown in FIG. 4.
Figure 6C:
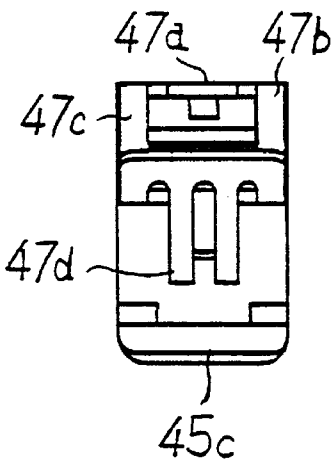
Figure 6A:
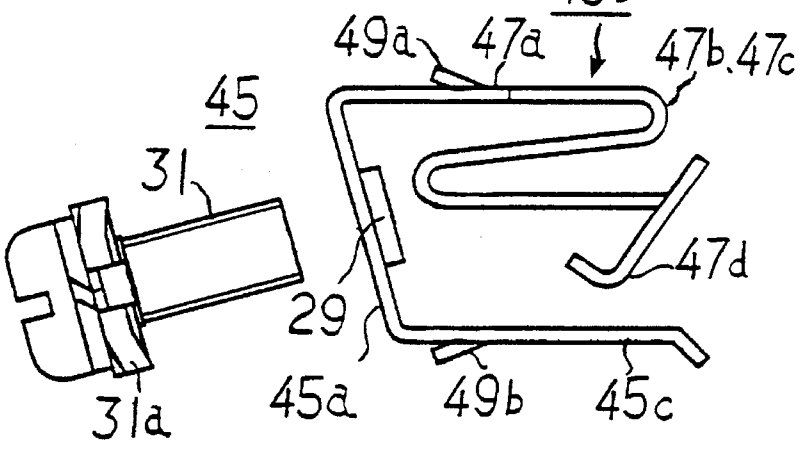
Figure 6B:
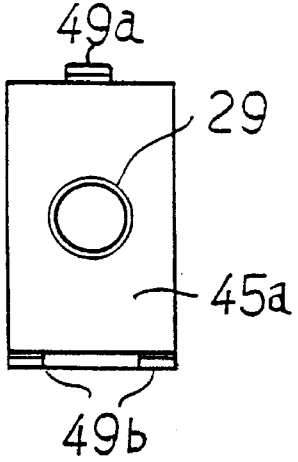
Figure 7:
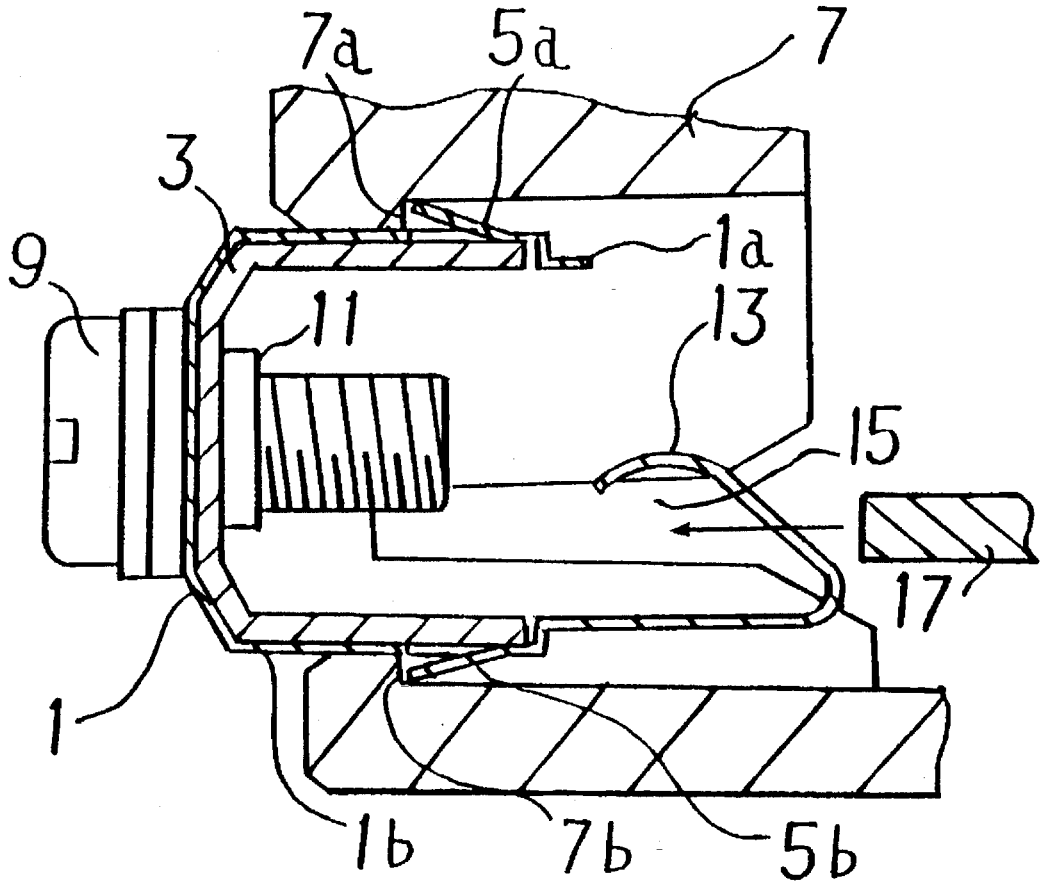
FIG. 7 (PRIOR ART)
FIG. 7 is a sectional view showing a conventional electric terminal having an external end adapted to be connected to an external lead and an internal end adapted to engage a connecting electrode of a circuit board.

FIGS. 4 to 6 show a second embodiment of the terminal assembly according to the present invention, which is different from the first embodiment in the shape of the terminal member.

The terminal member 45 of the second embodiment comprises a middle piece 45*a* and a pair of arms 45*b* and 45*c* extending from opposite ends of the middle piece 45*a*, and the middle piece 45*a* extends obliquely with respect to the first arm 45*b* so that the terminal screw 32 extends toward the first arm 45*b*.

In this regard, the second embodiment is not different from the first embodiment, but the entire terminal member 45 is made of an electroconductive plate member having a uniform thickness, and the first arm 45a has a certain feature in its shape.

More specifically, the first arm 45b consists of three spring pieces 47a, 47b and 47c (the spring piece 47c is hidden in FIG. 4) which are bent from an end of the middle piece 45a at an acute angle toward the second arm 45c. The spring piece 47a extends from a middle part of an associated end of the middle piece 45a for a short distance, and an engagement projection 49a is cut out from the material to be engaged by an engagement step 27a of the casing 27.

The spring pieces 47b and 47c are arranged on either side of the central spring piece 47a at a certain distance, and are formed substantially into the shape of letter-Z in the space defined between the first and second arms 45b and 45c by first being bent at an acute angle from the free ends of the spring portions 47b and 47c toward the middle piece 45a and bent back away from the middle piece 45a so as to define a contact piece 47d which comes into contact with the contact electrode 39 of the circuit board 35. Numeral 49b in FIGS. 4 to 6 denotes an engagement projection which engages with an engagement step 27b of the casing 19.

According to the second embodiment of the present invention, once an edge of the circuit board 35 is pushed into the retaining groove 37 of the retaining wall 33, the contact piece 47d formed at the free end of the spring pieces 47b and 47c of the first arm 45b resiliently and electrically comes into contact with the connecting electrode 39 of the circuit board 35.

Because the first arm 45b of the terminal member 45 consists of the two spring pieces 47b and 47c and the short spring piece 47a located between them, and the space 51 for passing through the terminal screw 31 is defined between the Z-shaped spring pieces 47b and 47c, the terminal screw 31 is effectively prevented from touching the first arm 45b.

In the second embodiment of the present invention, the terminal member 45 is formed into the shape of letter-C by being provided with the middle piece 45a, and the first and second arms 45b and 45c extending from two opposite ends of the middle piece 45a, and the first arm 45b is formed with the spring pieces 47b and 47c bent into the shape of letter-Z and directed toward the second arm 45c from a middle portion of the first arm 45b toward the free end thereof, the free ends of the spring pieces 47b and 47c being bent back toward the middle piece 45a at an acute angle.

Therefore, even when the terminal member 45 is entirely made of a relatively thick electroconductive plate member, the contact piece 47d or in other words the spring pieces 47b and 47c can resiliently and electrically come into contact with the connecting electrode 39 of the circuit board 35.

Furthermore, even when the terminal screw 31 is directly threaded into the middle piece 45a of the terminal member 45, it is possible to retain the terminal screw 31 in a reliable and stable fashion because the middle piece 45a has a sufficient thickness, and the structure can be simplified through elimination of the conventional nut member.

Because the middle piece 45a of the terminal member 45 extends obliquely with respect to the first arm 45b and the rear surface of the casing 19, it is possible to arrange a plurality of such terminal members 45 in the casing 19 close to one another. Furthermore, because the retaining window 21 for receiving the terminal member 45 can be made smaller, a relatively large number of terminal members can be arranged even in a small system such as a measuring instrument, and the functionality of the system can be improved.

Because a space 51 for accommodating the threaded terminal screw 31 is formed in the first arm 45b, the restriction on the length of the terminal screw 31 is thereby reduced, and the terminal screw 31 is effectively prevented from contacting the first arm 45b. The second embodiment also has the advantage when depositing solder on the circuit board 35.

Thus, according to the first embodiment of the present invention, because the parts of the terminal member through which the terminal screw is threaded and in which the engagement portions for engagement with the casing are formed can be made relatively thick while the spring portion which is to be connected to the circuit board received in the casing can be reduced in thickness, the resulting reduction in the number of component parts and simplification of the assembling work contributes to the reduction in cost, and the reliability can be improved by ensuring a resilient contact between the terminal member and the circuit board.

According to the first embodiment, because the middle piece of the terminal member extends obliquely with respect to the first arm, and the external lead wire or the external terminal piece can be thereby mounted on the terminal member from an oblique angle, the gaps between adjacent terminal members can be reduced without causing any inconvenience in making connections. It also means that a number of terminal members can be arranged close to one another in a limited space, and the retaining portions of the casing for the terminals can be reduced in size so that a large number of terminal members can be arranged even in a small measuring instrument.

Furthermore, according to the first embodiment, if a terminal screw having such a length as not to contact the first arm is threaded into the terminal member, and the spring portion of the first arm is bent into the shape of letter-U to press it upon the circuit board, because a space is defined between the terminal screw and the second arm for accommodating the circuit board, it is possible to press the circuit board onto the first arm without interfering with the terminal screw.

According to the second embodiment of the present invention, even when the terminal member is entirely made of a thick electroconductive member, it is still possible to resiliently engage the terminal member with the circuit board, and the terminal screw can be retained in a reliable and stable fashion. In the same way as the first embodiment, the number of component parts can be reduced, and the assembling work is simplified so that the fabrication cost is reduced, and the reliability of connection can be increased.

According to the second embodiment of the present invention, because the middle piece of the terminal member extends obliquely with respect to the first and second arms, and the external lead wire or the external terminal piece can be thereby mounted on the terminal member from an oblique angle, the same advantage as that of the first embodiment can be obtained. In the second embodiment also, the advantage at the time of soldering the circuit board 35 can be obtained in the same manner as with the first embodiment.

Furthermore, according to the second embodiment of the present invention, if a space is defined in the first arm for accommodating the terminal screw, because a space is produced between the terminal screw and second arm for receiving the circuit board, the circuit board can be pressed upon the first arm without interfering with the terminal screw, and the restriction on the length of the terminal screw can be reduced.

Although the present invention has been described in terms of specific embodiments thereof, it is possible to modify and alter details thereof without departing from the spirit of the present invention.

What we claim is:

1. An electric terminal assembly adapted to be fitted in an window of a casing of electric or electronic equipment, comprising:

a terminal member made of electroconductive material and including a middle piece having an outwardly facing surface, a first arm extending inwardly from a first end of said middle piece, and a second arm extending inwardly from a second end of said middle piece, said first arm being provided with a spring portion adapted to resiliently engage a connecting electrode provided on an edge of a circuit board fitted in said casing, at least one of said arms being provided with means for engagement with said casing for retaining said terminal member in said window; and a terminal screw threaded into a threaded opening provided in said outwardly facing surface of said middle piece;

said spring portion consisting of an integral extension of said first arm having a reduced thickness and curved into the shape of letter-J.

2. An electric terminal assembly according to claim 1, wherein said first arm is bent from said middle piece at an acute angle while said second arm is bent from said middle piece at an obtuse angle so that said outwardly facing surface of said middle piece defines an inclined outer surface through which said terminal screw is threaded.

3. An electric terminal assembly according to claim 1, wherein said spring portion consists of an integral extension of said first arm which is cut into at least a pair of narrow strips extending lengthwise from said first arm and defining a central slot for accommodating a forward end of said terminal screw.

4. An electric terminal assembly adapted to be fitted in an window of a casing of electric or electronic equipment, comprising:

a terminal member made of electroconductive material and including a middle piece having an outwardly facing surface, a first arm extending inwardly from a first end of said middle piece, and a second arm extending from a second end of said middle piece, said first arm being provided with a spring portion adapted to resiliently engage a connecting electrode provided on an edge of a circuit board fitted in said casing, at least one of said arms being provided with means for engagement with said casing for retaining said terminal member in said window; and a terminal screw threaded into a threaded opening provided in said outwardly facing surface of said middle piece;

said spring portion consisting of an integral extension of said first arm which is bent at least twice back and forth so as to have an increased flexibility.

5. An electric terminal assembly according to claim 4, wherein said first arm is bent from said middle piece at an acute angle while said second arm is bent from said middle piece at an obtuse angle so that said outwardly facing surface of said middle piece defines an inclined outer surface through which said terminal screw is threaded.

6. An electric terminal assembly according to claim 4, wherein said spring portion consists of an integral extension of said first arm which is cut into at least a pair of narrow strips extending lengthwise from said first arm and defining a central slot for accommodating a forward end of said terminal screw.

* * * * *